US005434587A

United States Patent [19]

Hannan

[11] Patent Number: 5,434,587

[45] Date of Patent: Jul. 18, 1995

[54] WIDE-ANGLE POLARIZERS WITH REFRACTIVELY REDUCED INTERNAL TRANSMISSION ANGLES

[75] Inventor: Peter W. Hannan, Smithtown, N.Y.

[73] Assignee: Hazeltine Corporation, Greenlawn, N.Y.

[21] Appl. No.: 119,936

[22] Filed: Sep. 10, 1993

[51] Int. Cl.[6] ..... H01Q 19/00

[52] U.S. Cl. ..... 343/909; 343/754; 343/756

[58] Field of Search ..... 343/754, 756, 909, 911 R, 343/853, 793; H01Q 19/00; 29/600

[56] References Cited

U.S. PATENT DOCUMENTS

| | | | |
|---|---|---|---|
| 2,921,312 | 1/1960 | Wickersham, Jr. | 343/756 |
| 3,754,271 | 8/1973 | Epis | 343/909 |
| 4,387,377 | 6/1983 | Kandler | 343/756 |
| 4,652,886 | 3/1987 | Rosser et al. | 343/756 |
| 4,772,890 | 9/1988 | Bowen et al. | 343/756 |
| 4,786,914 | 11/1988 | Wy et al. | 343/909 |
| 4,901,086 | 2/1990 | Smith | 343/756 |
| 5,258,768 | 11/1993 | Smith | 343/786 |

*Primary Examiner*—Donald Hajec
*Assistant Examiner*—Tan Ho
*Attorney, Agent, or Firm*—Edward A. Onders; Kenneth P. Robinson

[57] ABSTRACT

The usable range of incidence angles for electromagnetic wave polarizers using arrays of polarizer elements is increased by introduction of a dielectric medium having a dielectric constant large enough to reduce the angle of wave incidence upon the polarizer elements. For example, arrays of 45 degree inclined meander-line polarizer elements are encased in a dielectric medium having a dielectric constant of about 3. The polarizer includes impedance matching layers at the surfaces of the dielectric medium to reduce reflections at those surfaces. The resulting polarizer is indicated to be usable to reciprocally convert an incident polarization to a desired polarization (e.g., from linear to circular polarization) for waves with incidence angles from zero to 70 degrees in any plane.

19 Claims, 1 Drawing Sheet

WIDE-ANGLE POLARIZERS WITH REFRACTIVELY REDUCED INTERNAL TRANSMISSION ANGLES

This invention relates to polarizers usable with antennas and, more particularly, to polarizers capable of changing the polarization of an electromagnetic wave from linear to circular for a wide range of incidence angles, such as from zero to 70 degrees.

BACKGROUND OF THE INVENTION

There have previously been described polarizers for changing polarization from linear to circular in operation with electromagnetic waves having a frequency within a frequency band and having an angle of incidence within a range of angles. However, the usable incidence angle range of prior polarizers has been limited. For example, a linearly-polarized phased-array antenna may be arranged to electronically scan a radiated beam to any angle from zero to 70 degrees off broadside in any plane. Conversion of such linear polarization to circular polarization may be accomplished by a polarizer placed in front of the phased-array, however the performance of prior polarizers has degraded substantially over such a range of incidence angles.

More specifically, prior designs of circular polarizers may incorporate several spaced arrays of susceptance elements which are oriented at 45 degrees to an incident linear polarization for broadside incidence of an incident wave (i.e., a zero degree angle of incidence). However, at larger angles of incidence the polarizer elements will no longer have an orientation close to 45 degrees relative to the electric field vector of the incident wave. As a result, the polarizer performance degrades as the angle of incidence increases (for example, the axial ratio increases, so that the resulting polarization is no longer circular) and the polarizer becomes unusable beyond a limited range of incidence angles. Thus, performance of a typical prior such polarizer may degrade rapidly beyond a zero to 35 degree angle of incidence range. Also, the susceptance of such polarizer elements changes as the incidence angle is changed. These changes in susceptance, which are likely to be different for E-plane incidence and H-plane incidence, also limit the usable incidence angle range for prior polarizers.

Basic wide-band linear to circular polarizer concepts were described by D. S. Lerner in "A Wave Polarization Converter for Circular Polarization", *IEEE Trans. Antennas and Propagation,* Vol. AP-13, pp. 3–7, Jan. 1965. Further developments of meander-line elements for use in such polarizers were described by Young, Robinson and Hacking in "Meander-Line Polarizer", *IEEE Trans. Antennas and Propagation,* Vol. AP-21, pp. 376–378, May 1973 and by Chu and Lee in "Analytical Model of a Multilayered Meander-Line Polarizer Plate with Normal and Oblique Plane-Wave Incidence", *IEEE Trans Antennas and Propagation,* Vol AP-35, pp. 652–661, June 1987. The latter two articles discuss the theory and design of meander-lines, which are polarization changing elements in the form of continuous zigzag conductive patterns supported on thin dielectric sheets. As is well known, such polarizer elements appear essentially capacitive for an incident electric field perpendicular to length of such meander-lines and appear essentially inductive for an incident electric field parallel to the length of the meander-lines. The meander-line approach can provide improved axial ratio and improved frequency band performance. However, as described and shown by Chu and Lee, for a polarizer using known design techniques both the transmission coefficient and the input VSWR began to degrade rapidly for scan angles greater than about 30 degrees (see page 658 and FIGS. 6(*a*) and 6(*b*) of the referenced Chu and Lee article). In their Conclusion, at page 659 Chu and Lee particularly point out that: "It is shown that because the powers contained in the E-type and H-type modes of the incident wave are not equal for oblique incidence, there will be degradation in axial ratio when the meander-line polarizer is used in the oblique incidence case."

FIG. 1 shows an array of polarizer elements in the form of a parallel array 10 of meander-line elements 14 oriented at 45 degrees from the horizontal and vertical. Polarizer element arrays of this type, formed as a thin metallic pattern, are used in prior polarizers. As described in the references cited above, a basic metallic pattern, such as array 10, mounted on one surface of a thin dielectric: support sheet has typically been used in polarizers incorporating three or more of such array sheets maintained in spaced parallel relation by relatively thick foam intermediate layers positioned between the array sheets. In such configurations, the thin support sheets are specified to provide required structural support of FIG. 1 type arrays, while minimizing the operative effect of the inclusion of the dielectric material necessitated for such support purposes. Similarly, in such prior configurations, the thicker foam intermediate layers are of very low dielectric: constant material and are also designed to minimize the operative effect of the presence of these intermediate foam spacing layers. Thus, in the types of prior polarizers, as described, the arrays of polarizer elements (e.g., the meander-lines 14) are intended to produce the desired polarization change, and the support sheets and foam spacers are intended to have only minimal effects in the operation of the polarizer. As noted above, as the angle of incidence of an incident wave increases beyond a limited angular range, the performance of such prior polarizers rapidly degrades.

It is therefore an object of this invention to provide improved polarizers and, particularly, such polarizers usable with phased-array antennas to provide polarization conversion (e.g., linear to circular, vertical to horizontal, etc.) over a wide range of incidence angles.

Additional objects are to provide polarizers capable of performance over a wider range of incidence angles than prior devices, or capable of improved performance over a range of incidence angles within which prior devices are operable, or both.

Further objects are to provide antenna systems incorporating wide-angle polarizers, and new and improved polarizers which avoid disadvantages or limitations of prior devices.

SUMMARY OF THE INVENTION

In accordance with the invention, in an antenna for radiating a scanned beam with a predetermined polarization and including an array of radiating elements arranged for providing a linearly polarized radiated beam at a scan angle from broadside, a polarizer includes a dielectric medium at least one-quarter wavelength thick at a frequency in an operating frequency band and having a dielectric constant of at least two. The polarizer is positioned in front of the array of radiating elements for transmitting such radiated beam with an angle of transmission within the dielectric medium which is smaller than the scan angle of the radiated beam. The polarizer also includes polarizer element means, positioned within the dielectric medium at an orientation angle relative to the electric field vector of the radiated beam in the dielectric medium, for changing the polarization of the radiated beam from the linear polarization to the predetermined polarization. Also included are a first impedance-matching layer contiguous to a first side of the dielectric medium facing toward the array of radiating elements and a second impedance-matching layer contiguous to a second side of the dielectric medium facing away from the array of radiating elements, for reducing reflections of the radiated beam at such first and second sides of the dielectric medium. The polarizer is arranged to cause a wave transmitted within the dielectric medium to be incident upon the polarizer element means at an angle smaller than such scan angle for reciprocally changing polarization of signals radiated from and received by the array of radiating elements.

Also in accordance with the invention, a method for changing the polarization of an electromagnetic wave incident at an incidence angle, comprises the steps of:

(a) passing the electromagnetic wave through a first layer of material having a first dielectric constant to a contiguous surface of a dielectric medium having a second dielectric constant higher than such first dielectric constant, the first layer being arranged to reduce reflections of such wave at the contiguous surface over a range of incidence angles;

(b) passing such electromagnetic wave from the first layer of material into the dielectric medium to transmit such wave within the dielectric medium with a reduced angle of transmission, relative to the incidence angle of such wave;

(c) changing the polarization of such electromagnetic wave by interaction of the reduced angle wave with polarization elements positioned within the dielectric medium; and (d) passing such electromagnetic wave from a second surface of the dielectric medium, after such interaction with the polarization elements, to a contiguous second layer of material having characteristics similar to the first layer of material so as to reduce reflections at the second surface of the dielectric medium.

Polarizers and methods in accordance with the invention are thus reciprocally operable to change the polarization (e.g., linear to circular and vice versa) of electromagnetic waves incident over an incidence angle range, which is enhanced by said reduced angle of transmission within said dielectric medium.

For a better understanding of the invention, together with other and further objects, reference is made to the accompanying drawings and the scope of the invention will be pointed out in the accompanying claims.

DESCRIPTION OF THE INVENTION

Figure 1:
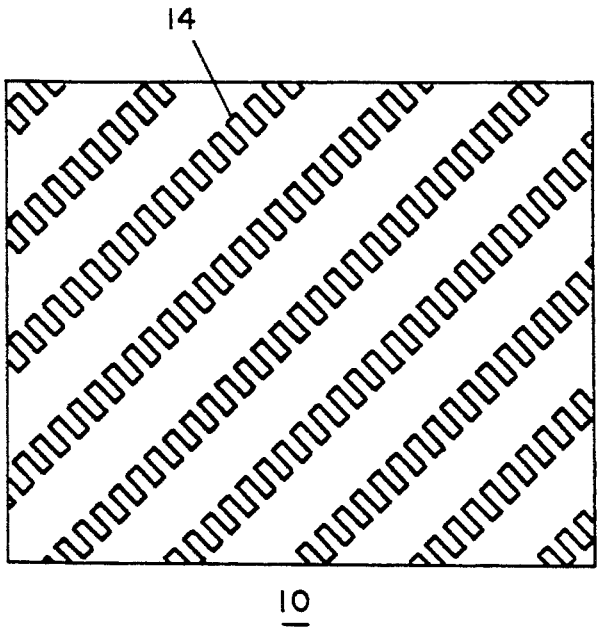
FIG. 1 shows an array of meander-line polarizer elements.
Figure 2:
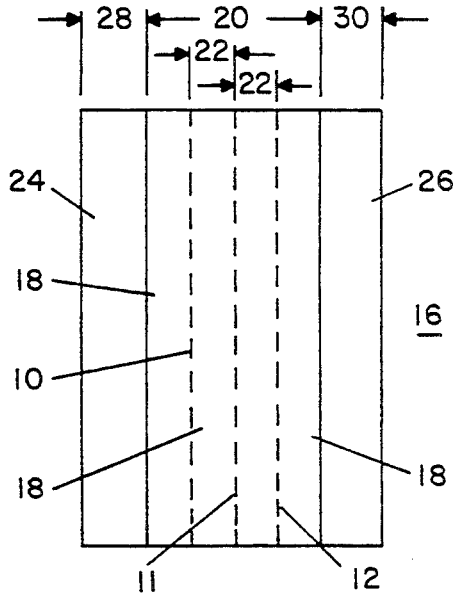
FIG. 2 is a sectional side-view of polarizer in accordance with the invention, which utilizes polarizer element arrays of the type shown in FIG. 1.

Referring now to FIG. 2, there is shown a view of a portion of a polarizer 16 constructed in accordance with the invention. FIG. 2 equally represents both a side, cross-sectional view of the polarizer portion and a top, cross-sectional view of the portion of polarizer 16. As will be described, the polarizer 16 comprises a plurality of polarizer element arrays, such as array 10 of FIG. 1, enclosed within dielectric material, so that FIG. 1 can be considered to represent both a front view and a mirror-reversed back view of polarizer 16 (assuming that an enclosed element array could be viewed through the intermediate portions of dielectric material, which will be described). As shown in FIG. 2, polarizer 16 includes a dielectric medium 18 having a thickness 20, which may typically exceed one-half wavelength at a frequency in an operating frequency band. References to wavelength will normally refer to free-space wavelength at a design frequency in an intended operating frequency band, unless otherwise noted. An important characteristic of dielectric medium 18 is that it has a dielectric constant "K" which is significantly higher than the dielectric constant $K=1$ for free space. A dielectric constant $K=3$ is a typical value for dielectric medium 18 in the illustrated embodiment of the invention. In other arrangements the dielectric constant of dielectric medium 18 may typically have a value of $K=2$ or greater.

The FIG. 2 polarizer also includes polarizer element means 10, 11 and 12 positioned within the dielectric medium 18, for changing the polarization of an incident wave from linear to circular polarization, for example. Polarizer element means 10 in FIG. 2 may comprise an array of meander-line elements 14 (such as shown in FIG. 1) positioned at an orientation angle of 45 degrees relative to the nominal direction of the electric field vector of an incident wave as transmitted within the dielectric medium 18 (e.g., a vertically polarized wave). The "nominal" direction of the electric field vector is defined for this purpose as the direction of such vector when the electromagnetic wave is incident at a zero degree angle of incidence, recognizing that the actual direction of the electric field vector of a scanned beam, relative to a meander-line element, will depend upon the specific scan angle and resulting angle of transmission of the wave in the dielectric medium. This is a cause of the "oblique incidence" degradation experienced in the above-cited article. In the FIG. 2 embodiment, element means 12 is a meander-line element array identical to element array 10 and element means 11 is a meander-line element array which is similar to element arrays 10 and 12, but whose dimensions are chosen for polarization changing effectiveness when used in combination with arrays 10 and 12. The actual configurations and dimensions for meander-line element arrays for particular embodiments can be determined by individuals skilled in this field using known design techniques, once they have a understanding of the invention. In the FIG. 2 embodiment, the element arrays 10, 11 and 12 are supported within dielectric medium 18 in a parallel configuration equally spaced by dimension 22, which may desirably be approximately equal to one-quarter wavelength divided by the square root of K at a frequency in an operating frequency band. With an understanding of the invention, it will be apparent to workers skilled in this field that the combination of element arrays 10, 11 and 12 and dielectric medium 18 can be implemented in a variety of ways, including placement of conductive patterns on layers of dielectric material which are then combined or adhered together to effectively provide a substantially homogeneous and continuous medium 18 with the arrays 10, 11 and 12 supported within. In particular embodiments, the element arrays may be formed on thin sheets of dielectric material of dielectric constant higher or lower than the dielectric constant of medium 18, with the dielectric constant of medium 18 chosen to provide the described operative result.

The polarizer, as shown in FIG. 2, further includes a first impedance-matching layer 24 contiguous to a first side of the dielectric medium 18 and a second impedance matching layer 26 contiguous to a second side of the dielectric medium 18 facing away from layer 24. For a wave incident at an incidence angle off broadside (i.e., not perpendicular to the left or right side of polarizer 16 in FIG. 2) reflections will tend to occur at the surface of a dielectric medium which represents the interface between air (having a dielectric constant K=1) and a dielectric medium having a significantly higher dielectric constant, such as K=3 for example. Such reflections are significantly reduced over an operating frequency band by provision of impedance-matching layers 24 and 26 having appropriately selected thicknesses and dielectric constants, which in many cases will be identical for the two layers 24 and 26. In the FIG. 2 embodiment, if dielectric medium 18 has a dielectric constant K=3, impedance matching layers 24 and 26 may comprise sections of dielectric material having a dielectric constant of about K=1.5 and thicknesses 28 and 30 typically on the order of 0.3 wavelength at a frequency in an operating frequency band. More particularly, for use with a dielectric medium 18 having a dielectric constant K=3, the thickness 28 of matching layer 24 may be determined as follows relative to a wavelength in an operating frequency band:

$$D = \frac{\lambda}{\sqrt[4]{K_m}\cos\theta_m} \quad (1)$$

Where $K_m$ is the dielectric constant of the matching layer 24 (e.g., 1.5) and $\Theta_m$ is the transmission angle within layer 24 for a selected angle of incidence (e.g., 45 degrees for a 60 degree incidence angle and a 1.5 dielectric constant). This results in a dimension 28 thickness of 0.29 wavelength for a non-reflective match at the 60 degree incidence angle, which provided excellent results over the desired zero to 70 degree incidence angle range. In other embodiments, layers 24 and 26 may each be a composite of multiple layers of material of different thickness or dielectric constant, or both, or other known techniques may be employed to provide the desired impedance matching effect at the surfaces of dielectric medium 18.

A particular design of a FIG. 2 type polarizer includes three meander-line element arrays 10, 11 and 12, with spacings 22 of 0.16 wavelength, positioned within a medium 18 having a dielectric constant K=2.94. A bonding film having a dielectric constant of about 2.9 is used to bond array-bearing sections of dielectric material to form a dielectric medium 18 as shown in FIG. 2, which is substantially homogeneous in this example. Matching layers 24 and 26, formed of single sections of material having a dielectric: constant K=1.5, approximately, and thickness of 0.29 wavelengths, are bonded to the opposite faces of medium 18 by use of the same bonding film. The thickness 20 of the dielectric: medium 18, which is 0.667 wavelength in this example, is generally not a critical dimension, but may typically be thick enough to extend the surfaces of medium 18 outward beyond the arrays 10 and 12 sufficiently to avoid effects of near-field interactions involving the dielectric interface (e.g., 18/24 interface) and the element arrays 10 and 12. Analysis shows this polarizer to provide very good performance in a predetermined operating frequency band within a range of 20 to 45 GHz for angles of wave incidence from zero to 70 degrees in any plane (i.e., incidence angles to 70 degrees in any lateral direction from broadside).

In other arrangements, polarizer elements such as linear conductors, unconnected rectangular elements such as described in the Lerner article, or having other forms may be substituted for meander-line elements as described and polarizers may include more or less than the three arrays of elements as used in the described example. In polarizers incorporating only one or two polarizer element arrays, the required thickness of dielectric medium 18 may be significantly less than the 0.667 wavelength thickness described (e.g., thickness 20 may be of the order of one-quarter wavelength).

Figure 3:
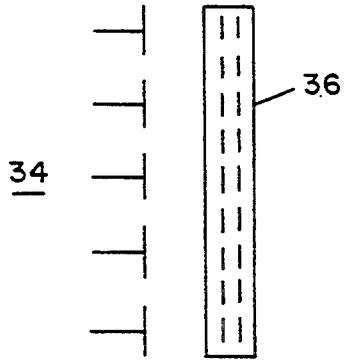
FIG. 3 is a simplified side-view of an antenna in accordance with the invention, including a phased array of dipole elements and a polarizer.

With respect to the operation of polarizers in accordance with the invention, one key aspect is the inclusion of a dielectric medium 18 having a dielectric constant high enough to significantly change the performance of arrays of polarizer elements in the context of large angles of incidence of an incident wave. FIG. 3 shows a side view of an array of linearly-polarized dipoles 34 and associated circular polarizer 36. Dipole array 34 represents a side view of rows and columns of dipoles fed as a phased array. In use, the surface of polarizer 36 closest to array 34 acts as a wave-entry surface during transmission of an electromagnetic wave which exits from the other surface of polarizer 36. During reception, the wave-entry and wave-exit surfaces are reversed, with the polarizer operating reciprocally. Known operation of such a phased array antenna would permit radiation into the polarizer 36 of a linearly-polarized beam scanable in any lateral direction over a range of scan angles from zero to 70 degrees. However, if circular polarizer 36 were a typical polarizer as previously available, both the axial ratio and insertion loss would begin to increase rapidly beyond a scan angle in excess of a value such as 35 degrees off broadside. With inclusion of a dielectric medium 18 of higher dielectric constant in accordance with the invention, Snell's law relating to refractive effects on a wave transitioning at an angle from a first medium, to a second medium having a relatively higher dielectric constant, indicates that the angle of wave transmission in the second medium will be decreased. More particularly, by application of the relationship $$\frac{\sin\theta_1}{\sin\theta_2} = \sqrt{K} \quad (2)$$

it will be seen that introduction of a dielectric medium having a dielectric constant as low as K=2 will be effective to reduce a first angle of incidence in free space of 50 degrees, for example, to an angle of transmission within the medium of approximately 33 degrees. Thus, on a simplified analysis, an array of polarizer elements which provide efficient polarization conversion only up to an angle of 33 degrees, could operate efficiently for incidence angles to 50 degrees if the polarizer elements are encased in a dielectric medium having a dielectric constant K=2, in accordance with the invention. Of course, larger dielectric constant mediums can further extend the operable angular range so that a free space incidence angle of 70 degrees becomes a transmission angle of only 33 degrees in a dielectric medium having a dielectric constant of K=3. In the design of a polarizer, the dimensions of an array of meander-line elements may require some adjustment to take into account operation of the array within the dielectric medium.

On a further analytical level, the circular polarization performance for an incident wave that is linearly polarized is dependent upon the relative effects produced upon the $E_\perp$ electric field vector component which is perpendicular to the element axis as compared with the $E_{||}$ electric field vector component which is orthogonal to the $E_\perp$ component and is nominally parallel to the element axis. Ideally, such parallel and perpendicular electric field components have and maintain a ratio of unity (i.e., 1), as occurs at broadside incidence when there is a 45 degree angle between the incident electric field vector and the axis of the meander-line elements. In this case, if the polarizer elements shift the phase of one electric field component relative to the other by 90 degrees, the linearly polarized incident wave will have its polarization changed to perfect circular polarization. Actually, the two electric field components do not maintain a unity ratio in practice as the incidence angle departs from broadside incidence.. When the 45 degree orientation exists for broadside incidence, the following relationships indicate the change in the $E_{||}$ to $E_\perp$ magnitude ratio that occurs as the incidence angle increases:

$$\frac{E_|}{E_\perp} = \frac{1}{\sqrt{1 - \frac{\sin^2 \Theta_{OH}}{K}}} \quad \text{for } H\text{-plane incidence} \tag{3}$$

$$\frac{E_|}{E_\perp} = \sqrt{1 - \frac{\sin^2 \Theta_{OE}}{K}} \quad \text{for } E\text{-plane incidence} \tag{4}$$

Where $\Theta_{OH}$ and $\Theta_{OE}$ are the angles of incidence in free space measured off broadside in the H and E planes, respectively, and K is the dielectric constant of the dielectric medium 18 in which the polarizer elements are embedded.

It will be seen that in the absence of a dielectric medium (i.e., K=1) a large angle of incidence (70 degrees, for example) will cause the parallel and perpendicular electric vector components to have a ratio substantially different from unity. This will cause a poor axial ratio and large insertion loss. However, with inclusion of a dielectric medium having a substantial dielectric: constant (K=3, for example) the ratio of the parallel and perpendicular components remains close to unity, even for an angle of incidence of 70 degrees. This enables the axial ratio to remain close to unity and insertion loss of the polarizer to remain small.

Figure 4A:
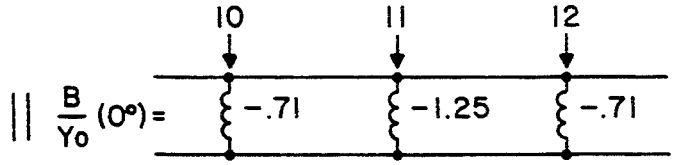
FIGS. 4A and 4B are equivalent circuits useful in describing a FIG. 2 type polarizer.
Figure 4B:
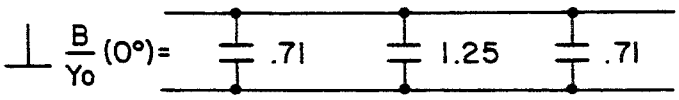

FIGS. 4A and 4B show simplified equivalent circuits for the FIG. 2 type polarizer for which exemplary dimensions and dielectric constants were given above. FIG. 4A indicates, for the $E_{||}$ component, the design values of susceptance B of the embedded elements relative to the free space admittance $Y_o$ for each of the polarizer arrays 10, 11 and 12 of FIG. 2. Similarly, FIG. 4B indicates such design values for the $E_\perp$ component. As noted, analysis of this polarizer design showed very good axial ratio and insertion loss performance for angles of wave incidence from broadside to 70 degrees off broadside. It will be appreciated that, while the invention has been described particularly in the context of reciprocally changing between linear and circular polarizations, the invention is also applicable to polarizers providing other changes in polarization.

While there have been described the currently preferred embodiments of the invention, those skilled in the art will recognize that other and further modifications and variations may be made without departing from the invention and it is intended to claim all such modifications as fall within the scope of the invention.

What is claimed is:

1. In an antenna for radiating a scanned beam with a predetermined polarization and including an array of radiating elements arranged for providing a linearly polarized radiated beam at a scan angle from broadside, a polarizer comprising:

a dielectric medium, at least one-quarter wavelength thick at a frequency in an operating frequency band and having a dielectric constant of at least two, positioned in front of said array of radiating elements for transmitting said radiated beam with an angle of transmission within said dielectric medium which is smaller than said scan angle of said radiated beam;

polarizer element means, positioned within said dielectric medium at an orientation angle relative to the electric field vector of said radiated beam in said dielectric medium, for changing the polarization of said radiated beam from said linear polarization to said predetermined polarization; and a first impedance-matching layer contiguous to a first side of said dielectric medium facing toward said array of radiating elements and a second impedance-matching layer contiguous to a second side of said dielectric medium facing away from said array of radiating elements, for reducing reflections of said radiated beam at said first and second sides of said dielectric medium;

said polarizer being arranged to cause a wave transmitted within said dielectric medium to be incident upon said polarizer element means at an angle smaller than said scan angle for reciprocally changing polarization of signals radiated from and received by said array of radiating elements.

2. An antenna having a polarizer as in claim 1, wherein said polarizer element means comprise planar arrays of meander-line elements supported within said dielectric medium.

3. An antenna having a polarizer as in claim 1, wherein said orientation angle is nominally 45 degrees and said predetermined polarization is circular polarization.

4. An antenna having a polarizer as in claim 1, wherein said first side of said dielectric medium is planar and is positioned normal to the broadside beam centerline of said radiated beam.

5. An antenna having a polarizer as in claim 1, wherein said dielectric medium comprises substantially homogenous dielectric material having a dielectric constant of at least 2.5 enclosing a plurality of spaced arrays of conductive polarizer elements.

6. An antenna having a polarizer as in claim 1, wherein said radiating elements are arranged for providing a radiated beam scannable over a range of scan angles from broadside to 70 degrees off broadside in all planes.

7. An electromagnetic wave polarizer, operable with an electromagnetic wave incident upon a wave-entry surface of said polarizer at an entry angle within a range of incidence angles, comprising:

a first impedance-matching layer, having a wave-entry surface and a first dielectric constant, for reducing reflections of said electromagnetic wave;

a dielectric medium, contiguous to a second surface of said first impedance-matching layer and having a thickness of at least one-quarter wavelength at a frequency in an operating frequency band and a second dielectric constant which is greater than said first dielectric constant and is at least 2, for transmitting said electromagnetic wave with an angle of transmission within said dielectric medium which is smaller than said entry angle as a result of refractive effects;

polarizer element means, positioned within said dielectric medium at an orientation angle relative to the nominal direction of the electric field vector of said electromagnetic wave in said dielectric medium, for changing the polarization of said electromagnetic wave; and a second impedance-matching layer, contiguous to a side of said dielectric medium facing away from said first impedance-matching layer and having a third dielectric constant which is lower than said second dielectric constant and a wave-exit surface, for reducing reflections of said electromagnetic wave;

said polarizer being arranged to cause said electromagnetic wave to be incident upon said polarizer element means at an angle smaller than said entry angle and to operate reciprocally so that said wave-exit and wave-entry surfaces are also respectively usable as wave-entry and wave-exit surfaces.

8. A polarizer as in claim 7, wherein said first and second impedance-matching layers are similar sheets of a dielectric: material having a dielectric constant between one and said second dielectric constant of said dielectric medium.

9. A polarizer as in claim 7, wherein said dielectric medium comprises substantially homogeneous dielectric material having a dielectric constant of at least 2.5 enclosing and supporting a plurality of spaced arrays of polarizer elements.

10. A polarizer as in claim 9, wherein said polarizer elements are meander-line elements oriented at 45 degrees, relative to said nominal direction of said electric field vector of said electromagnetic wave in said dielectric medium, for changing the polarization of an incident wave from linear to circular.

11. A polarizer, usable with incident electromagnetic waves having angles of incidence which may exceed a limited angular range, comprising:

polarizer element means, including a plurality of polarizer elements, for providing a desired polarization change for incident waves having angles of incidence within said limited angular range;

dielectric means, enclosing and supporting said polarizer elements and having a dielectric constant of at least two, for providing a medium having a dielectric constant effective to cause refractive effects reducing the transmission angle of an incident wave from an angle of incidence exceeding said limited angular range to an angle of transmission in said dielectric means which is within said limited angular range; and impedance matching means, coupled to incident wave entry and exit surfaces of said dielectric means, for reducing reflections of said incident wave at said entry and exit surfaces of said dielectric means;

said polarizer being arranged so that a wave transmitted within said dielectric means is incident upon said polarizer elements at an angle smaller than the angle of incidence of said wave upon said polarizer.

12. A polarizer as in claim 11, wherein said dielectric means has a thickness of at least one-quarter wavelength at a frequency in an operating frequency band.

13. A polarizer as in claim 11, wherein said polarizer elements comprise meander-line conductive patterns positioned within said dielectric means, which comprises a substantially homogeneous dielectric medium at least one-quarter wavelength thick at a frequency in an operating frequency band.

14. A polarizer as in claim 13, wherein said meander-line conductive patterns have a 45 degree orientation relative to the nominal direction of the electric field vector of said incident wave in said dielectric means.

15. A method for changing the polarization of an electromagnetic wave incident at an incidence angle, comprising the steps of:

(a) passing an electromagnetic wave through a first layer of material having a first dielectric constant to a contiguous surface of a dielectric medium having a second dielectric constant higher than said first dielectric constant, said first layer being arranged to reduce reflections of said wave at said contiguous surface over a range of incidence angles;

(b) passing said electromagnetic wave from said first layer of material into said dielectric medium to transmit said wave within said dielectric medium with a reduced angle of transmission, relative to said incidence angle of said wave;

(c) changing the polarization of said electromagnetic wave by interaction of said wave with polarization elements positioned within said dielectric medium; and (d) passing said electromagnetic wave from a second surface of said dielectric medium, after said interaction with said polarization elements, to a contiguous second layer of material having characteristics similar to said first layer of material so as to reduce reflections at said second surface of said dielectric medium;

said method being reciprocally operable to change the polarization of electromagnetic waves incident over an incidence angle range which is enhanced by effects of said reduced angle of transmission within said dielectric medium.

16. A method as in claim 15, wherein step (b) comprises passing said electromagnetic wave into a dielectric: medium having a dielectric constant of at least 2.

17. A method as in claim 15, wherein step (b) comprises passing said electromagnetic wave into a dielectric medium having a thickness of at least one-quarter wavelength at a frequency in an operating frequency band.

18. A method as in claim 15, wherein step (a) comprises passing said electromagnetic wave into said first layer with the electric field vector of said wave aligned at a nominally 45 degree angle relative to said polarization elements positioned within said dielectric medium, for changing linear polarization to circular polarization.

19. A method as in claim 15, wherein step (b) comprises passing said electromagnetic wave into a substantially homogeneous dielectric medium, at least three-eighths wavelength thick at a frequency in an operating frequency band, which encloses and supports a plurality of spaced arrays of said polarization elements.

* * * * *